US007284466B1

(12) United States Patent
Ho

(10) Patent No.: US 7,284,466 B1
(45) Date of Patent: Oct. 23, 2007

(54) HAND TOOL HAVING REPLACEABLE TIPS

(75) Inventor: Shin-Chi Ho, Dali (TW)

(73) Assignee: Yeh Shing Enterprise Co., Ltd, Dali (TW)

( * ) Notice: Subject to any disclaimer, the term of this patent is extended or adjusted under 35 U.S.C. 154(b) by 0 days.

(21) Appl. No.: 11/654,266

(22) Filed: Jan. 17, 2007

(51) Int. Cl.
*B25B 23/00* (2006.01)

(52) U.S. Cl. ..... 81/439; 81/436; 81/440; 81/489; 81/490

(58) Field of Classification Search ..... 81/436, 81/439, 440, 489, 490
See application file for complete search history.

(56) References Cited

U.S. PATENT DOCUMENTS 6,305,256 B1 * 10/2001 Anderson et al. ..... 81/490
6,332,384 B1 * 12/2001 Cluthe ..... 81/490
6,510,768 B2 * 1/2003 Fruhm ..... 81/490

* cited by examiner

*Primary Examiner*—Joseph J. Hail, III
*Assistant Examiner*—Shantese McDonald
(74) *Attorney, Agent, or Firm*—Alan Kamrath; Kamrath & Associates PA

(57) ABSTRACT

A hand tool includes a handle body, a cover having two exposing slots and a stop plate formed with a passage, and two rotation wheels each rotatably mounted in the handle body and each having an inside formed with receiving holes to receive tips and a peripheral wall formed with an opening that is movable to align with the respective exposing slot and the passage of the cover. Thus, the user only needs to rotate the rotation wheels to select and take out the desired tip, thereby facilitating the user operating the hand tool. In addition, the tips are directly stored in the handle body so that the user needs not to additionally prepare a storage box to store the tips, thereby facilitating the user carrying the hand tool.

20 Claims, 5 Drawing Sheets

HAND TOOL HAVING REPLACEABLE TIPS

BACKGROUND OF THE INVENTION

1. Field of the Invention

The present invention relates to a hand tool, such as a screwdriver and the like, and, more particularly, to a hand tool having replaceable tips.

2. Description of the Related Art

A conventional hand tool, such as a screwdriver and the like, comprises a tool handle having a front end provided with a drive shank for mounting a plurality of tips. Thus, the drive shank co-operates a plurality of replaceable tips of different types, such as a flat-headed tip, cross-headed tip and the like, so as to drive workpieces of different types, such as a screw, nut, bolt and the like, thereby enhancing the versatility of the hand tool. However, the user needs to additionally prepare a storage box to store the tips when the tips have a larger number, thereby causing inconvenience to the user when carrying the hand tool.

BRIEF SUMMARY OF THE INVENTION

In accordance with the present invention, there is provided a hand tool, comprising a handle body having an inside formed with a receiving chamber, a cover having two spaced exposing slots each connected to the receiving chamber of the handle body and having a stop plate formed with a passage connected between the exposing slots, and two rotation wheels each rotatably mounted in the receiving chamber of the handle body and each having an inside formed with a plurality of receiving holes to receive a plurality of tips and a peripheral wall formed with an opening that is movable to align with a respective exposing slot of the cover and the passage of the stop plate of the cover.

The primary objective of the present invention is to provide a hand tool, wherein the user only needs to rotate the rotation wheels to select and take out the desired tip, thereby facilitating the user operating the hand tool.

Another objective of the present invention is to provide a hand tool, wherein the tips are received in the receiving holes of the rotation wheels and are directly stored in the handle body so that the user needs not to additionally prepare a storage box to store the tips, thereby facilitating the user carrying the hand tool.

A further objective of the present invention is to provide a hand tool, wherein when each of the receiving holes of the rotation wheels is misaligned with the passage of the cover, the tips in the receiving holes of the rotation wheels are stopped by the stop plate of the cover and the stop wall of the handle body and will not be dropped out of the respective exposing slot of the cover so that the tips are positioned in the receiving holes of the rotation wheels exactly and stably.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
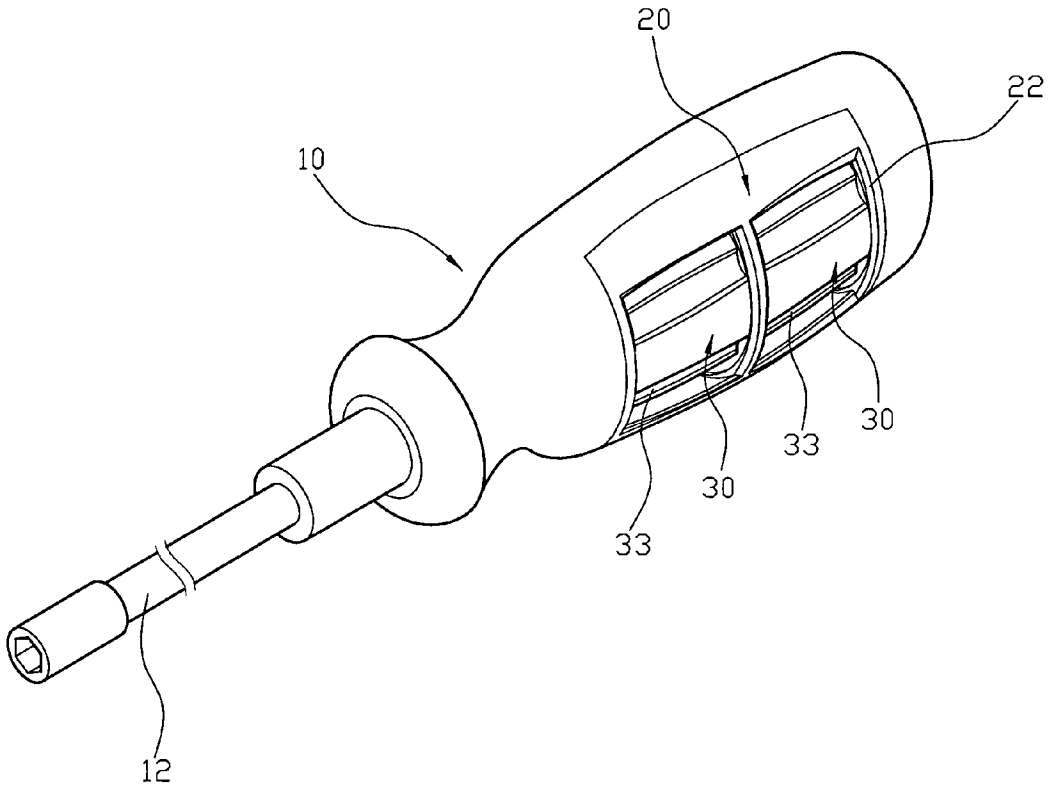
FIG. 1 is a perspective view of a hand tool in accordance with the preferred embodiment of the present invention.
Figure 2:
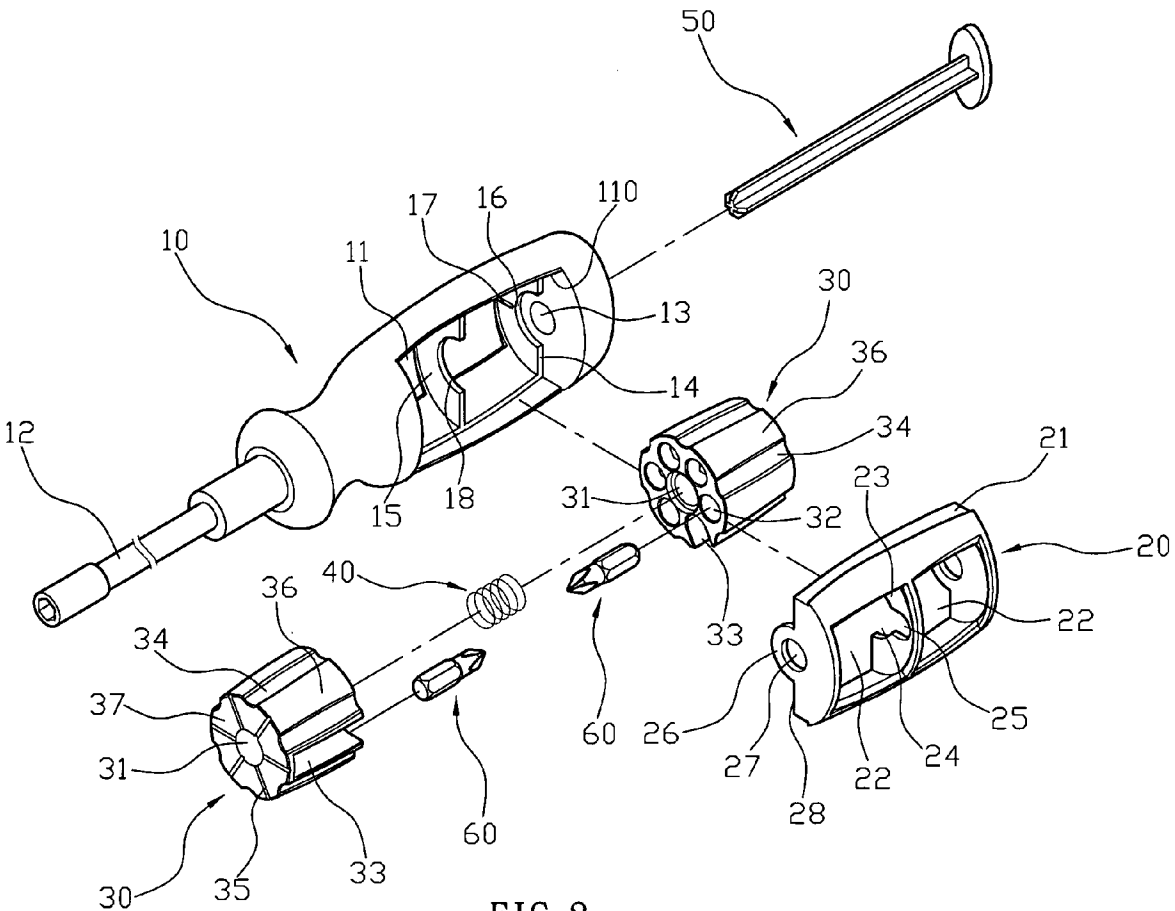
FIG. 2 is an exploded perspective view of the hand tool as shown in FIG. 1.
Figure 3:
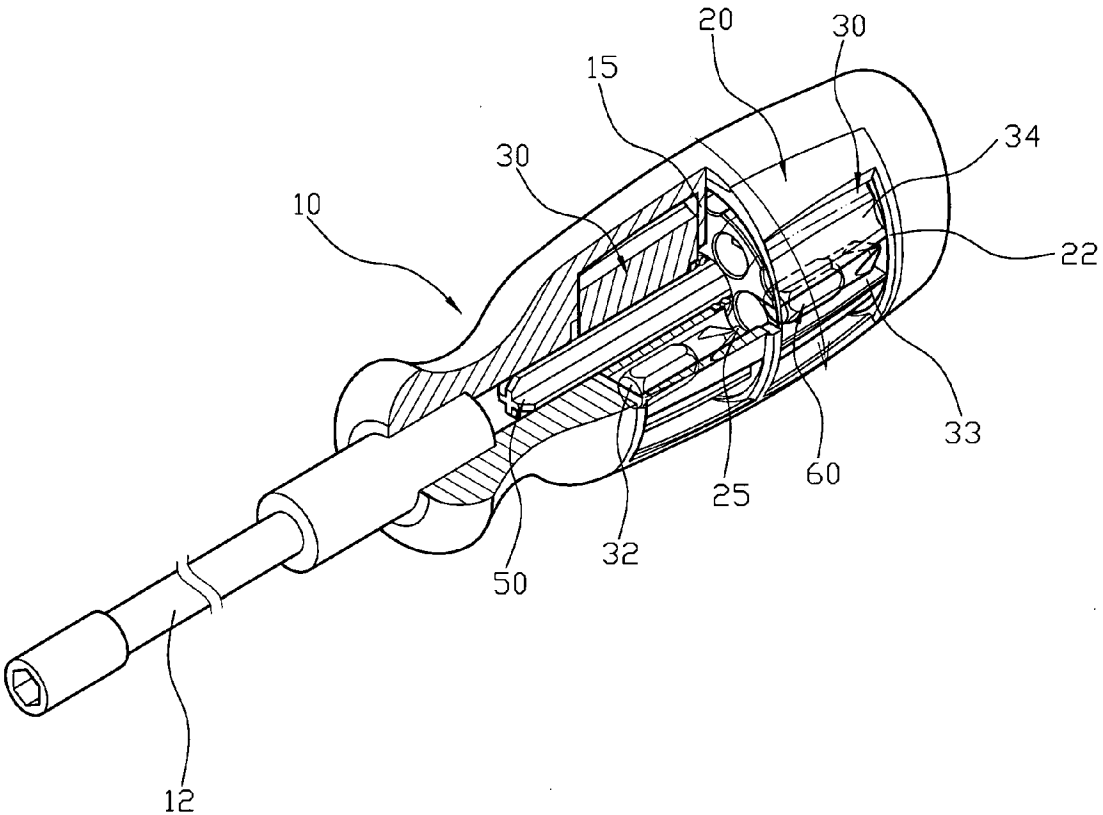
FIG. 3 is a partially perspective cross-sectional operational view of the hand tool as shown in FIG. 1.

Referring to the drawings and initially to FIGS. 1-3, a hand tool, such as a screwdriver and the like, in accordance with the preferred embodiment of the present invention comprises a handle body 10 having an inside formed with a receiving chamber 11, a cover 20 having two spaced exposing slots 22 each connected to the receiving chamber 11 of the handle body 10 and having a stop plate 23 formed with a passage 25 connected between the exposing slots 22, two rotation wheels 30 each rotatably mounted in the receiving chamber 11 of the handle body 10 and each having an inside formed with a plurality of receiving holes 32 to receive a plurality of tips 60 and a peripheral wall formed with an opening 33 that is movable to align with a respective exposing slot 22 of the cover 20 and the passage 25 of the stop plate 23 of the cover 20, and a shaft 50 extended through the handle body 10, the cover 20 and the rotation wheels 30 to attach the cover 20 to the handle body 10 and to allow rotation of the rotation wheels 30.

Thus, the rotation wheels 30 are rotatable to a position where the opening 33 of one of the rotation wheels 30 aligns with the respective exposing slot 22 and the passage 25 of the cover 20, and the respective tip 60 of one of the receiving holes 32 of the other one of the rotation wheels 30 aligns with the passage 25 of the cover 20 to allow the respective tip 60 to pass through the passage 25 of the cover 20 into the opening 33 of the one of the rotation wheels 30 and to pass through the respective exposing slot 22.

The handle body 10 has two end portions each formed with a shaft hole 13 connected to the receiving chamber 11 to allow passage of the shaft 50. A drive shank 12 is mounted on a front end of the handle body 10 for mounting the tips 60. The receiving chamber 11 of the handle body 10 has a mediate portion formed with a stop wall 15 juxtaposed to the stop plate 23 of the cover 20 to separate the rotation wheels 30. The stop wall 15 of the handle body 10 has an inside formed with a substantially arc-shaped channel 18 to allow passage of the shaft 50. The receiving chamber 11 of the handle body 10 has two opposite ends each formed with a substantially semi-circular stop flange 14. The stop flange 14 of the handle body 10 has an inside formed with a substantially arc-shaped groove 16 and has a side formed with a protruding positioning strip 17 aligning with the passage 25 of the cover 20.

The cover 20 is mounted on and has a shape matching that of an open side 110 of the receiving chamber 11 of the handle body 10. The cover 20 has a periphery formed with a recessed portion 21 engaged with the open side 110 of the receiving chamber 11 of the handle body 10. The cover 20 has two opposite ends 28 each stopped by the respective stop flange 14 of the handle body 10 and each formed with a substantially arc-shaped protruding ear 26 inserted into the groove 16 of the respective stop flange 14. The protruding ear 26 of the cover 20 is formed with a fixing hole 27 mounted on the shaft 50. The stop plate 23 of the cover 20 has a side formed with a breach 24 connected to the passage 25 to allow passage of the shaft 50.

The rotation wheels 30 are stored in the handle body 10 and the cover 20. Each of the rotation wheels 30 has a central portion formed with a shaft hole 31 to allow passage of the shaft 50 and has a peripheral wall formed with a plurality of anti-slip grooves 34 rested on a wall of the receiving chamber 11 of the handle body 10 to provide an anti-slip effect and a plurality of smooth faces 36 located between the anti-slip grooves 34 and each aligned with a respective receiving hole 32 to indicate the size, type or specification of a respective tip 60 by a mark, pattern or figure. Each of the rotation wheels 30 has an end face 37 rested on the respective stop flange 14 of the handle body 10 and formed with a plurality of positioning grooves 35, wherein the positioning strip 17 of the respective stop flange 14 is positioned in one of the positioning grooves 35 of the respective rotation wheel 30 to position the respective rotation wheel 30 temporarily. In addition, each of the positioning grooves 35 of each of the rotation wheels 30 aligns with a respective receiving hole 32 so that when the positioning strip 17 of the respective stop flange 14 is positioned in one of the positioning grooves 35 of the respective rotation wheel 30, the respective receiving hole 32 of the respective rotation wheel 30 is aligned with the passage 25 of the cover 20 to allow the respective tip 60 to pass through the passage 25 of the cover 20. The receiving holes 32 of one of the rotation wheels 30 face the receiving holes 32 of the other one of the rotation wheels 30. The receiving holes 32 and the opening 33 of each of the rotation wheels 30 surround the shaft hole 31.

The hand tool further comprises an elastic member 40 mounted in the receiving chamber 11 of the handle body 10 and biased between the rotation wheels 30 to push each of the rotation wheels 30 toward the respective stop flange 14 of the handle body 10 to prevent the rotation wheels 30 from being rotated freely. The elastic member 40 is mounted on the shaft 50 and located between the stop wall 15 of the handle body 10 and the stop plate 23 of the cover 20. The elastic member 40 has two ends each rested on the shaft hole 31 of a respective rotation wheel 30.

As shown in FIG. 3, when the opening 33 of a first one of the rotation wheels 30 aligns with the respective exposing slot 22 and the passage 25 of the cover 20, and the respective tip 60 of one of the receiving holes 32 of a second one of the rotation wheels 30 aligns with the passage 25 of the cover 20, the handle body 10 is inclined through an angle to allow the respective tip 60 to pass through the passage 25 of the cover 20 into the opening 33 of the first one of the rotation wheels 30 and to pass through the respective exposing slot 22 of the cover 20 so that the respective tip 60 will be dropped out of the respective exposing slot 22 of the cover 20 for use with a user.

Figure 4:
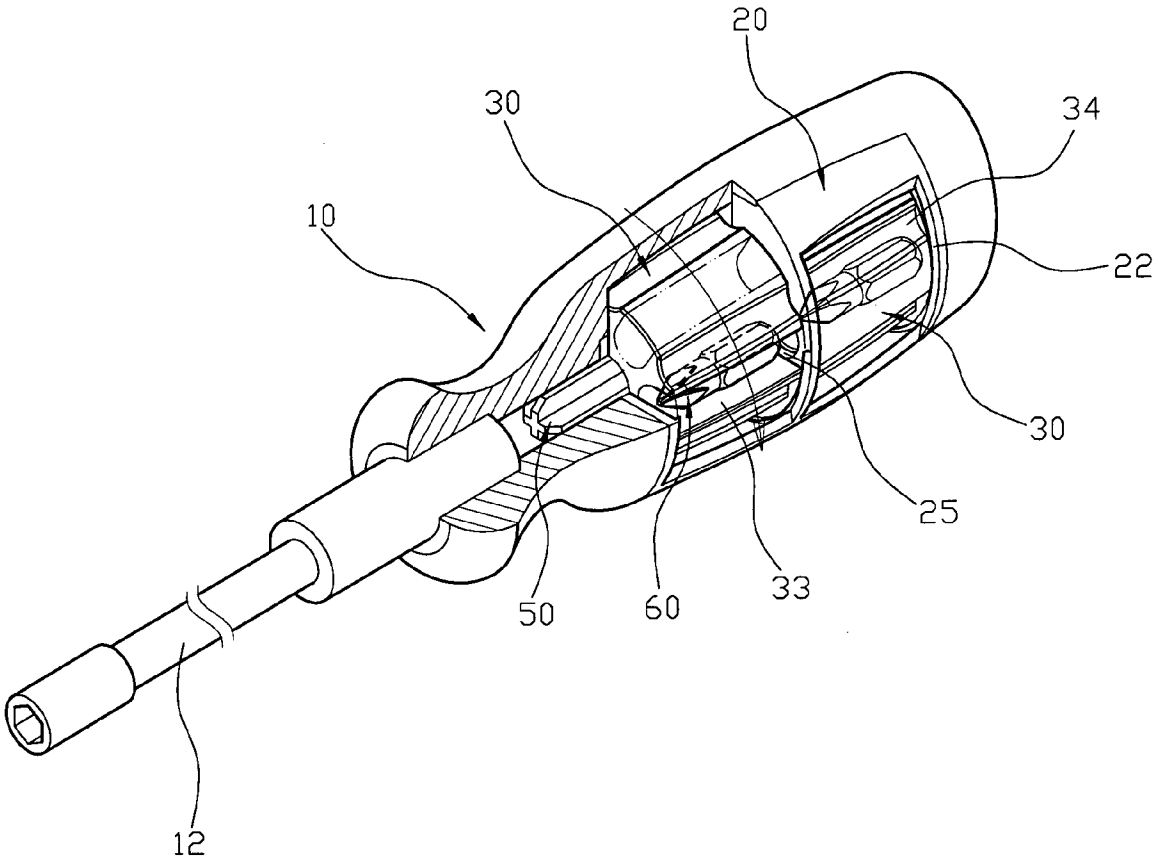
FIG. 4 is another partially perspective cross-sectional operational view of the hand tool as shown in FIG. 1.
Figure 5:
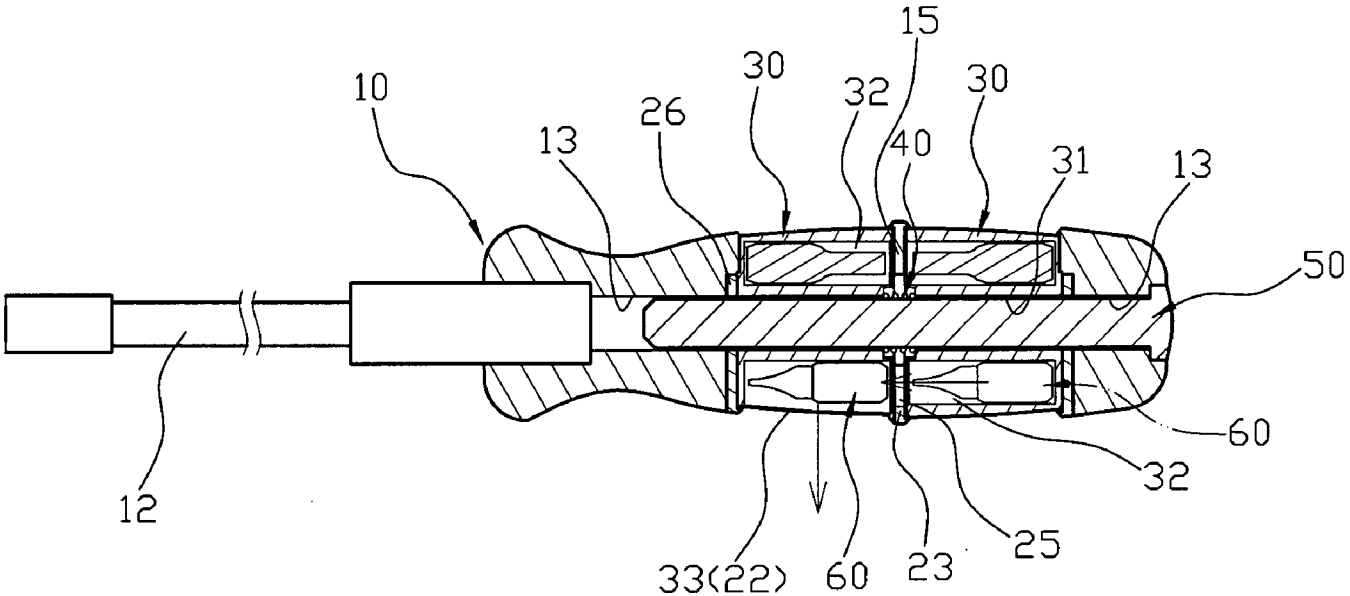
FIG. 5 is a front cross-sectional operational view of the hand tool as shown in FIG. 4.

As shown in FIGS. 4 and 5, when the opening 33 of the second one of the rotation wheels 30 aligns with the respective exposing slot 22 and the passage 25 of the cover 20, and the respective tip 60 of one of the receiving holes 32 of the first one of the rotation wheels 30 aligns with the passage 25 of the cover 20, the handle body 10 is inclined through an angle to allow the respective tip 60 to pass through the passage 25 of the cover 20 into the opening 33 of the second one of the rotation wheels 30 and to pass through the respective exposing slot 22 of the cover 20 so that the respective tip 60 will be dropped out of the respective exposing slot 22 of the cover 20 for use with the user.

On the contrary, when the rotation wheels 30 are rotatable to a position where each of the receiving holes 32 of the rotation wheels 30 is misaligned with the passage 25 of the cover 20, the tips 60 in the receiving holes 32 of the rotation wheels 30 are stopped by the stop plate 23 of the cover 20 and the stop wall 15 of the handle body 10 and will not be dropped out of the respective exposing slot 22 of the cover 20 so that the tips 60 are positioned in the receiving holes 32 of the rotation wheels 30 exactly and stably.

Accordingly, the user only needs to rotate the rotation wheels 30 to select and take out the desired tip 60, thereby facilitating the user operating the hand tool. In addition, the tips 60 are received in the receiving holes 32 of the rotation wheels 30 and are directly stored in the handle body 10 so that the user needs not to additionally prepare a storage box to store the tips 60, thereby facilitating the user carrying the hand tool. Further, when each of the receiving holes 32 of the rotation wheels 30 is misaligned with the passage 25 of the cover 20, the tips 60 in the receiving holes 32 of the rotation wheels 30 are stopped by the stop plate 23 of the cover 20 and the stop wall 15 of the handle body 10 and will not be dropped out of the respective exposing slot 22 of the cover 20 so that the tips 60 are positioned in the receiving holes 32 of the rotation wheels 30 exactly and stably.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A hand tool, comprising:

a handle body having an inside formed with a receiving chamber;

a cover having two spaced exposing slots each connected to the receiving chamber of the handle body and having a stop plate formed with a passage connected between the exposing slots;

two rotation wheels each rotatably mounted in the receiving chamber of the handle body and each having an inside formed with a plurality of receiving holes to receive a plurality of tips and a peripheral wall formed with an opening that is movable to align with a respective exposing slot of the cover and the passage of the stop plate of the cover.

2. The hand tool in accordance with claim 1, wherein the rotation wheels are rotatable to a position where the opening of one of the rotation wheels aligns with the respective exposing slot and the passage of the cover, and the respective tip of one of the receiving holes of the other one of the rotation wheels aligns with the passage of the cover to allow the respective tip to pass through the passage of the cover into the opening of the one of the rotation wheels and to pass through the respective exposing slot.

3. The hand tool in accordance with claim 1, wherein the receiving chamber of the handle body has a mediate portion formed with a stop wall juxtaposed to the stop plate of the cover.

4. The hand tool in accordance with claim 3, wherein the rotation wheels are rotatable to a position where each of the receiving holes of the rotation wheels is misaligned with the passage of the cover, and the tips in the receiving holes of the rotation wheels are stopped by the stop plate of the cover and the stop wall of the handle body so that the tips are positioned in the receiving holes of the rotation wheels.

5. The hand tool in accordance with claim 1, wherein the receiving chamber of the handle body has two opposite ends each formed with a stop flange having an inside formed with a groove, and the cover has two opposite ends each stopped by the respective stop flange of the handle body and each formed with a protruding ear inserted into the groove of the respective stop flange.

6. The hand tool in accordance with claim 5, wherein the stop flange of the handle body has a substantially semi-circular shape.

7. The hand tool in accordance with claim 5, wherein the groove the stop flange of the handle body is substantially arc-shaped.

8. The hand tool in accordance with claim 5, wherein the protruding ear of the cover is substantially arc-shaped.

9. The hand tool in accordance with claim 5, wherein each of the rotation wheels has an end face rested on the respective stop flange of the handle body and formed with a plurality of positioning grooves, and the stop flange of the handle body has a side formed with a protruding positioning strip aligning with the passage of the cover and positioned in one of the positioning grooves of the respective rotation wheel to position the respective rotation wheel temporarily.

10. The hand tool in accordance with claim 9, wherein each of the positioning grooves of each of the rotation wheels aligns with a respective receiving hole so that when the positioning strip of the respective stop flange is positioned in one of the positioning grooves of the respective rotation wheel, the respective receiving hole of the respective rotation wheel is aligned with the passage of the cover to allow the respective tip to pass through the passage of the cover.

11. The hand tool in accordance with claim 9, further comprising an elastic member mounted in the receiving chamber of the handle body and biased between the rotation wheels to push each of the rotation wheels toward the respective stop flange of the handle body to prevent the rotation wheels from being rotated freely.

12. The hand tool in accordance with claim 5, further comprising a shaft extended through the handle body, the cover and the rotation wheels to attach the cover to the handle body and to allow rotation of the rotation wheels.

13. The hand tool in accordance with claim 12, wherein the handle body has two end portions each formed with a shaft hole connected to the receiving chamber to allow passage of the shaft.

14. The hand tool in accordance with claim 12, wherein the protruding ear of the cover is formed with a fixing hole mounted on the shaft.

15. The hand tool in accordance with claim 12, wherein the receiving chamber of the handle body has a mediate portion formed with a stop wall juxtaposed to the stop plate of the cover to separate the rotation wheels, the stop wall of the handle body has an inside formed with a substantially arc-shaped channel to allow passage of the shaft, and the stop plate of the cover has a side formed with a breach connected to the passage to allow passage of the shaft.

16. The hand tool in accordance with claim 12, wherein each of the rotation wheels has a central portion formed with a shaft hole to allow passage of the shaft, and the receiving holes and the opening of each of the rotation wheels surround the shaft hole.

17. The hand tool in accordance with claim 1, wherein the cover is mounted on and has a shape matching that of an open side of the receiving chamber of the handle body.

18. The hand tool in accordance with claim 17, wherein the cover has a periphery formed with a recessed portion engaged with the open side of the receiving chamber of the handle body.

19. The hand tool in accordance with claim 1, wherein each of the rotation wheels has a peripheral wall formed with a plurality of anti-slip grooves rested on a wall of the receiving chamber of the handle body and a plurality of smooth faces located between the anti-slip grooves and each aligned with a respective receiving hole to indicate a size, type or specification of a respective tip by a mark, pattern or figure.

20. The hand tool in accordance with claim 1, wherein the rotation wheels are stored in the handle body and the cover, and the receiving holes of one of the rotation wheels face the receiving holes of the other one of the rotation wheels.

* * * * *